US005518413A

United States Patent [19]

Taniuchi et al.

[11] Patent Number: 5,518,413

[45] Date of Patent: May 21, 1996

[54] LEVER TYPE CONNECTOR

[75] Inventors: Osamu Taniuchi; Hitoshi Okumura; Hajime Kawase; Youichi Nankoh; Hiroyuki Nakata, all of Mie, Japan

[73] Assignee: Sumitomo Wiring Systems, Ltd., Yokkaichi, Japan

[21] Appl. No.: 425,708

[22] Filed: Apr. 19, 1995

Related U.S. Application Data

[63] Continuation of Ser. No. 177,394, Jan. 5, 1994, abandoned.

[30] Foreign Application Priority Data

Jan. 6, 1993 [JP] Japan ..... 5-017009
Jan. 6, 1993 [JP] Japan ..... 5-017010

[51] Int. Cl.[6] ..... H01R 13/62

[52] U.S. Cl. ..... 439/157

[58] Field of Search ..... 439/157, 153, 439/155, 160

[56] References Cited

U.S. PATENT DOCUMENTS 5,135,410 8/1992 Kawase et al. ..... 439/372
5,279,506 1/1994 Kawase et al. ..... 439/157
5,441,420 8/1995 Okumura et al. ..... 439/157
5,445,530 8/1995 Inoue et al. ..... 439/157
5,453,018 9/1995 Ito et al. ..... 439/157

FOREIGN PATENT DOCUMENTS 459448 12/1991 European Pat. Off. .
4-62772 2/1992 Japan .
2179506 3/1987 United Kingdom .
2271029 3/1994 United Kingdom ..... 439/157

*Primary Examiner*—Gary F. Paumen
*Attorney, Agent, or Firm*—Sughrue, Mion, Zinn, Macpeak & Seas

[57] ABSTRACT

A lever type connector of the present invention aims to effect a turning operation of a lever by a smooth and slight actuating force without forming the lever into a large size. In the lever type connector, cam faces 16*a* and 16*b* in a cam groove 16 displace a cam follower boss 17 by turning a lever 14, thereby coupling and detaching connector housings 11, 12. A shape of the cam faces 16*a* and 16*b* which contact with the cam follower boss upon coupling and detaching is formed in accordance with coupling and detaching resistances of a set of terminals. The cam groove 16 may be discontinuously formed by inserting and extracting resistances of the terminals so that a curved line is formed by combining two circular arcs through a point of inflection.

1 Claim, 9 Drawing Sheets

LEVER TYPE CONNECTOR

This is a Continuation of application Ser. No. 08/177,394 filed Jan. 5, 1994, now abandoned.

BACKGROUND OF THE INVENTION

1. Field of the Invention

This invention relates to a lever type connector in which coupling and detaching of the connector are effected by a cam action and more particularly to a lever type connector which has a single kind of terminal or different terminals which have the same or different timing of insertion and extraction of the connector.

2. Statement of the Prior Art

Such a kind of connector has the advantage of enabling a coupling and detaching operation by a small force and is applied to a multiple (more than twenty) electrode connector. The connector utilizes a "lever action" as a basic principle and is known by, for example, the Japanese Patent Public Disclosure No. 4-62772 (1992).

For convenience of explanation, a prior lever type connector will be explained by referring to FIGS. 10 to 12.

FIGS. 10A to 10B are side elevational views of a prior lever type connector, illustrating each of the coupling steps. FIGS. 11A and 11B are vector diagrams which illustrate a "lever action" in the prior lever type connector. FIG. 12 is a side elevational view of a prior lever, illustrating a shape of a cam groove.

As shown in FIGS. 10A to 10D and FIG. 12, a female connector housing 1 accommodating female terminals is disposed over a male connector housing 2 accommodating male terminals. The female connector housing 1 is adapted to be inserted into the male connector housing 2. A lever 4 having a cam groove 3 which effects the "lever action" is rotatably attached to the male connector housing 2. A cover 5 to be put on the female connector housing 1 is provided with a cam follower boss 6. As shown in FIG. 12, the cam groove 3 in the lever 4 is formed in a circular arc around a bearing bore 4*a* which is a rotation center of the lever 4. Opposite side end faces 3*a* and 3*b* in the cam groove 3 serve as cam faces.

As shown in FIG. 10B, when coupling both connector housings 1 and 2, the cam follower boss 6 on the cover 5 attached to the female connector housing 1 is inserted into the cam groove 3 in the lever 4 and then the lever 4 is turned in an anticlockwise direction shown by an arrow. As shown in FIG. 10C, the upper side end face 3*a* pushes down the cam follower boss 6 so that the cover 5 is pushed down and the terminals in both connector housings are deeply interconnected and then the female connector housing 1 is inserted into the male connector housing 2. When the lever 4 is turned to a position shown in FIG. 10D, the female connector housing 1 is completely inserted into the male connector housing 2 and the terminals in both housings are completely interconnected.

In the coupling process of the connector as the female and male terminals are interconnected, a strong insertion resistance acts on the female connector housing 1. However, since an insertion force which overcomes an insertion resistance caused by the lever action between the side end face 3*a* in the cam groove 3 and the cam follower boss 6 acts on the female connector housing 1, it is possible to insert the female connector housing 1 into the male connector housing 2 by a relatively light force.

On the contrary, when the connector is detached from the position shown in FIGS. 10D to the position shown in FIGS. 10A, the lever 4 is turned in the clockwise direction. Since the lower side end 3*b* in the cam groove 3 pushes up the cam follower boss 6, the female connector housing is extracted out of the male connector housing 1 against an extracting resistance caused by a frictional force between the female and male terminals.

Generally, as shown in FIGS. 11A and 11B, it is possible in this construction to make a vertical force $f_1$ acting on the cam follower boss 6 larger as an angle θ becomes smaller when θ in an angle between a horizontal line h and a line tangent to the cam face 3*a* at a point P contacting between the cam follower boss 6 and the cam face 3*a* in the cam groove 3. This will be apparent from comparison of vectors $f_1$ and $f_2$ in FIGS. 11A and 11B. Here, the vectors $f_1$ and $f_2$ are vertical and horizontal components of a force F acting on the cam follower boss 6. This means that the force acting on the cam follower boss 6 in connection with a rotation of the lever 4 depends upon a continuous change of the tangential line t on the cam face 3*a*, namely a curved line of the cam groove 3 in the lever type connector.

It will be understood from the coupling and detaching operation of the connector shown in FIGS. 10A to 10B that the right side end 3*a* in the cam groove 3 gives the cam action to the boss upon coupling of the connector and the left side end 3*b* in the cam groove 3 gives the cam action to the boss upon detaching of the connector as shown in an enlarged scale in FIG. 12.

On the other hand, when the insertion and extraction of the female and male terminals are carefully examined, changes in the respective resistances are observed to be different. That is, a curved line indicating a change of an insertion resistance upon insertion of the female and male terminals forms a peak when the female connector housing 1 is disposed in a shallow position in the male connector housing 2 since a larger insertion resistance is generated at a primary insertion of the terminals. Upon extraction of the terminals a larger extraction resistance is generated at a primary extraction of the terminals on account of a large stationary frictional force. A curved line indicating a change in the extraction resistance becomes a peak when the female connector housing 1 is disposed in a deep position in the male connector housing 2. This will be explained in more detail hereinafter.

However, since a width of the cam groove 3 in the prior lever type connector is substantially constant and thus the side ends 3*a* and 3*b* which serve as cam faces are set to be the same as each other, this construction does not exhibit the "lever action" effectively. That is, since the shape of the prior cam groove is designed to exhibit an even effect in coupling and detaching operations, for example, a sufficient insertion force can not be obtained under inserting terminals upon coupling the connector while a sufficient extraction force can not be obtained when initially extracting terminals upon detaching the connector. This means that a large actuating force must be applied to the lever and the lever must be a large size.

On the other hand, recently, a connector has been developed which has, for example, two kinds of terminals provided for an electrical power source supply and a signal transmission in a single connector housing. In this connector, generally, the terminals for the electrical power supply are of a large size while the terminals for the signal transmission are of a small size. When coupling the connector, the large terminals for the electrical power supply begin to interconnect and then the small terminals for the signal transmission begin to interconnect. Consequently changes in resistance upon insertion and extraction in connection with a turning operation of the lever 4 become a simple curve with a peak in the prior connector having a single kind of terminal and become a complex curve with two peaks in the connector having two kinds of terminals. This will be described in more detail hereinafter.

However, since the cam groove 3 in the lever 4 in the prior connector is formed into a simple circular arc as shown in FIG. 12, it is impossible to cause a force suitable for a change of insertion resistance to act on the female connector housing 1 and to operate the lever by a smooth and light force.

SUMMARY OF THE INVENTION

A first object of the present invention is to provide a lever type connector which can effectively generate a suitable force in response to a change of insertion and extraction of female and male terminals and can effect a turning operation of a lever by a smooth and light actuating force without making the lever large.

A second object of the present invention is to provide a lever type connector which can generate a suitable force in response to a change of resistance upon coupling and detaching the connector even if the connector has a plurality of kinds of terminals and can effect a turning operation of a lever by a smooth and light actuating force.

In order to achieve the first object, in a lever type connector of the present invention, a lever is rotatably connected to one of the connector housings to be coupled to each other, a cam follower boss is provided on the other of said connector housings, said boss is adapted to engage with a grooved cam formed in said lever, and said connector housings are coupled to and detached from each other by turning said lever so that said cam follower boss is displaced along a cam face on said grooved cam. The grooved cam on which said cam follower boss contacts upon coupling and detaching of said connector housings is shaped in accordance with coupling and detaching resistances of said connector housings.

The cam follower boss contacts with one cam face when the connector is coupled and it contacts with the other cam face when the connector is detached. Since the shapes of the cam faces are formed in accordance with the coupling and detaching resistances of the connector, a force most suitable for a change of resistance acts on the connector.

According to the lever type connector of the present invention, since a suitable force acts on the connector in response to a change of resistance upon coupling and detaching the connector, it is possible to effect the turning operation of the lever without making the lever large.

In order to achieve the second object, a lever type connector of the present invention has more than two kinds of terminals in which timings of insertion and extraction in the female and male connector housings are different. The shape of the cam groove in the lever is discontinuously formed in connection with the insertion and extraction timings of a plurality of kinds of terminals.

According to the lever type connector of the present invention, since the shape of the cam groove in the lever is discontinuously formed in connection with the insertion and extraction timings of the kinds of terminals, discontinuous coupling and detaching forces according to the shape of cam groove can be obtained in connection with the insertion and extraction timings of the kinds of terminals upon coupling and detaching the connector.

Accordingly, the lever type connector can generate discontinuous coupling and detaching forces according to the insertion and extraction timings of the terminals, thereby effecting the turning operation by a smooth and light force.

DETAILED DESCRIPTION OF THE PREFERRED EMBODIMENTS

Referring now to FIGS. 1 to 9, embodiments of a lever type connector of the present invention will be explained below.

Figure 3:
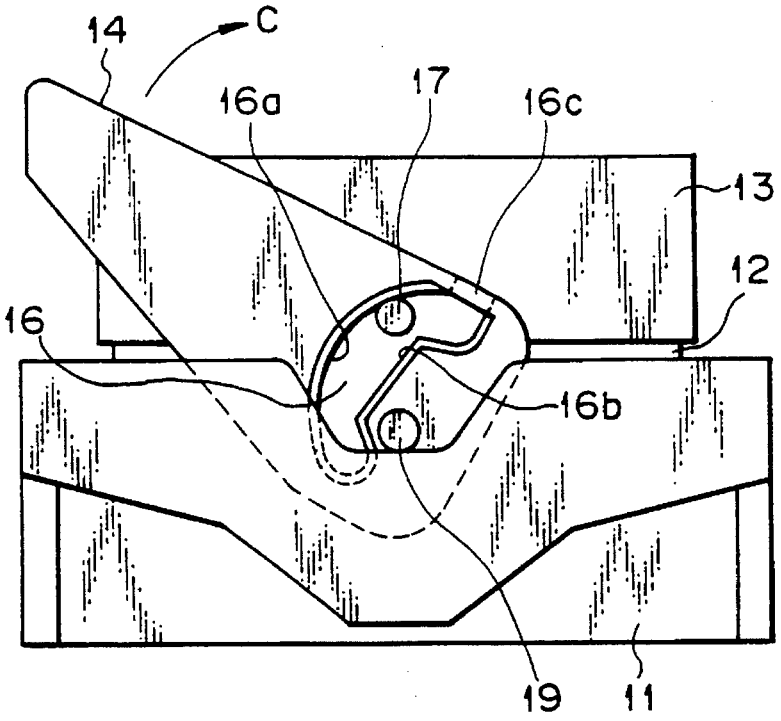
FIG. 3 is a schematic side elevational view of a connector of the present invention, illustrating a cam action upon coupling the connector.
Figure 4:
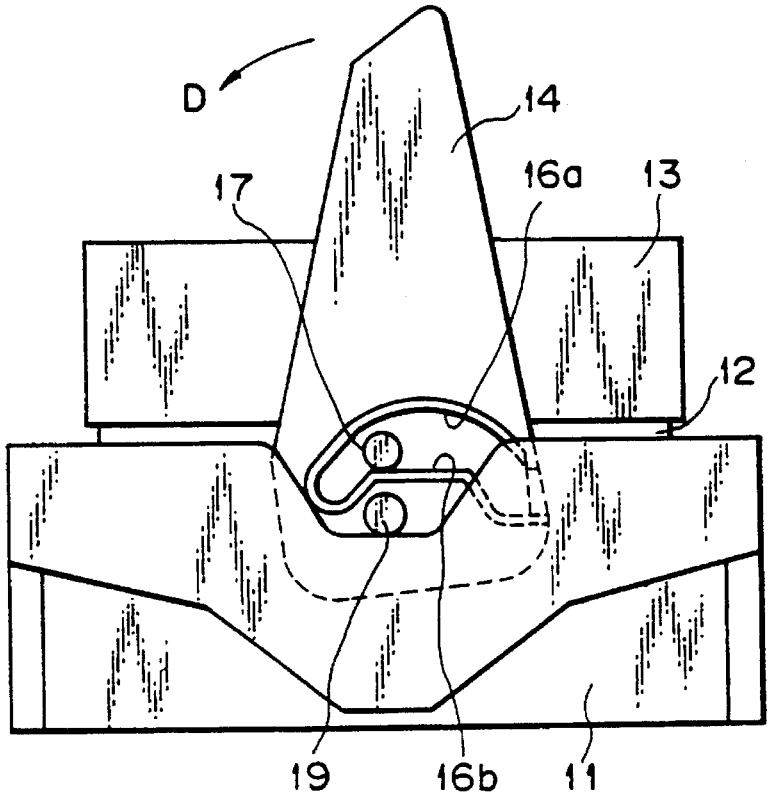
FIG. 4 is a schematic side elevational view of the connector, illustrating a cam action upon detaching the connector.
Figure 5:
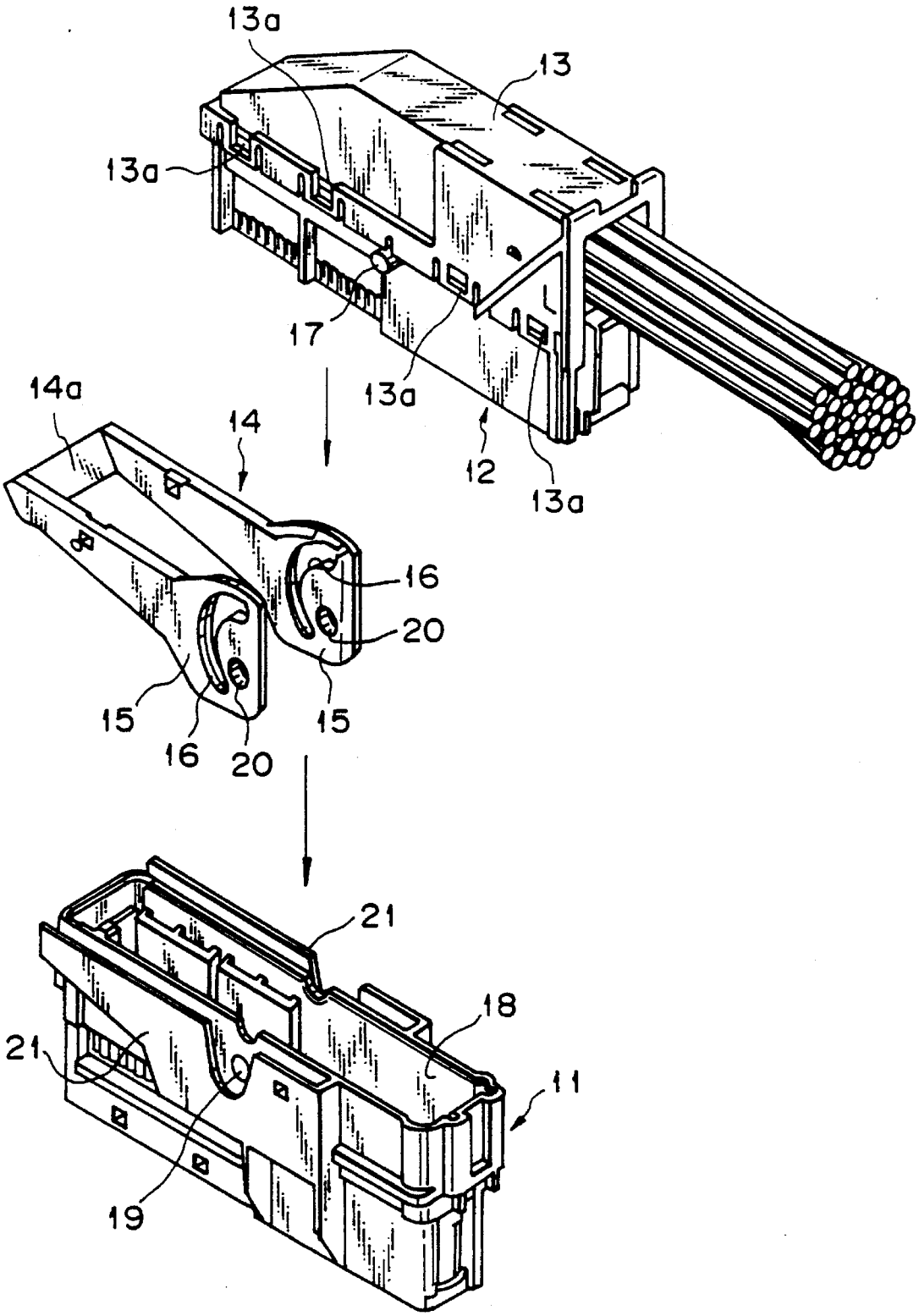
FIG. 5 is an exploded perspective view of the connector of the present invention.

FIGS. 1 to 6 show a first embodiment of the present invention. FIG. 5 shows a general construction of the lever type connector of the present invention. The connector includes a male connector housing 11 in which male terminals not shown are mounted and a female connector housing 12 in which female terminals not shown are mounted.

The female connector housing 12 is provided on an upper portion with a cover 13 which covers the portion. The cover 13 engages with the female connector housing 12 by means of a lock mechanism 13*a*. The female connector housing 12 is provided, on a center portion of opposite side walls of the female connector housing 12, with cam follower bosses 17 which engage with cam grooves in a lever described hereinafter.

On the other hand, the male connector housing 11 has a box like hood 18 which is open at an upper portion. The hood 18 is provided on opposite side walls with lever support shafts 19. The lever 14 has two legs 15 which are connected by a bridge member 14*a* at upper ends. Each leg 15 has a bearing bore 20 in which the lever support shafts 19. When the lever 14 is turned with the cam follower bosses 17 on the female connector housing 12 engaging with the cam groove 16, the cover 13 and thus the female connector housing 12 are displaced with respect to the male connector housing 11 by a cam action, thereby coupling and detaching the connector housings. The male connector housing 11 is integrally provided at opposite side walls with outer walls 21 which cover lower portions of the lever 14 attached to the housing 11.

Figure 1:
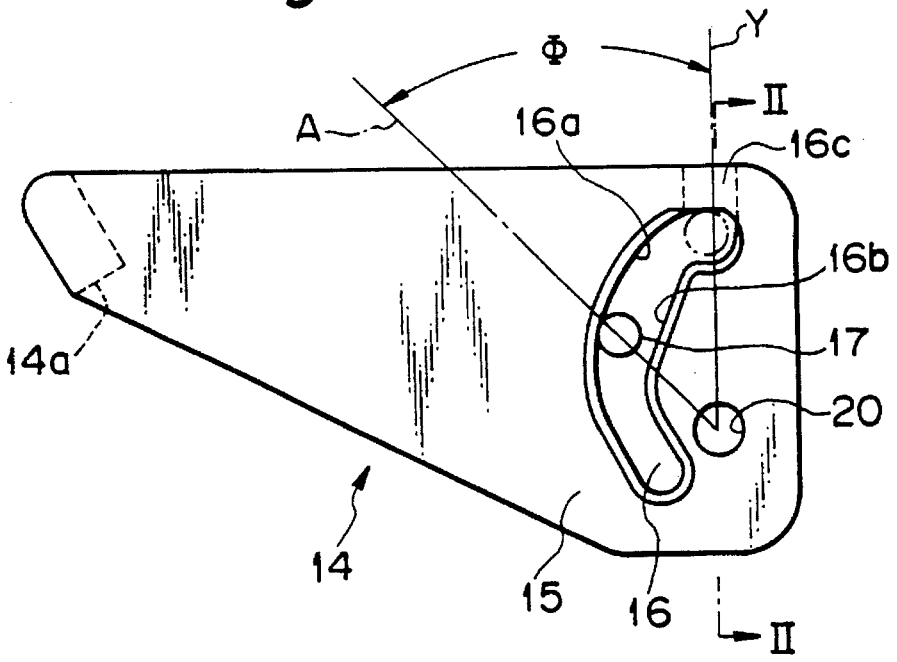
FIG. 1 is a side elevational view of an embodiment of a lever in accordance with the present invention.
Figure 2:
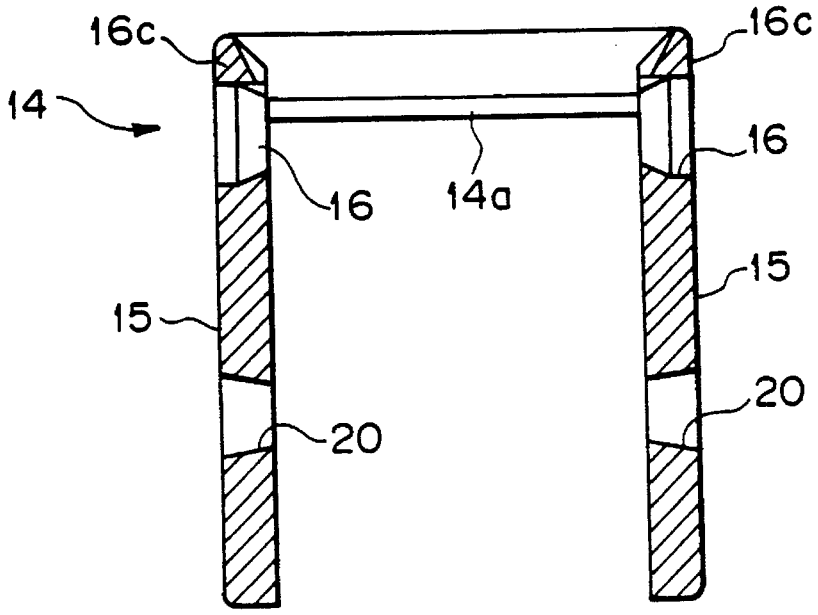
FIG. 2 is a cross sectional view of the lever taken along lines II—II in FIG. 1.

The shape of the cam groove 16 in the leg 15 of the lever 14 is shown in detail in FIG. 1. The cam groove 16 is formed into a circular arc around the bearing bore 20 in the leg 15 and is closed at an upper end by a thin boss guide 16C. When the female connector housing 12 is inserted into the hood 18 on the male connector housing 11, the cam follower boss 17 on the cover 13 elastically deflects the leg 15 of the lever 14 and advances through the boss guide 16C into the cam groove 16. A left side end 16*a* in the cam groove 16 serves as a cam face upon coupling the connector while a right side end 16*b* serves as a cam face upon detaching the connector.

Figure 6:
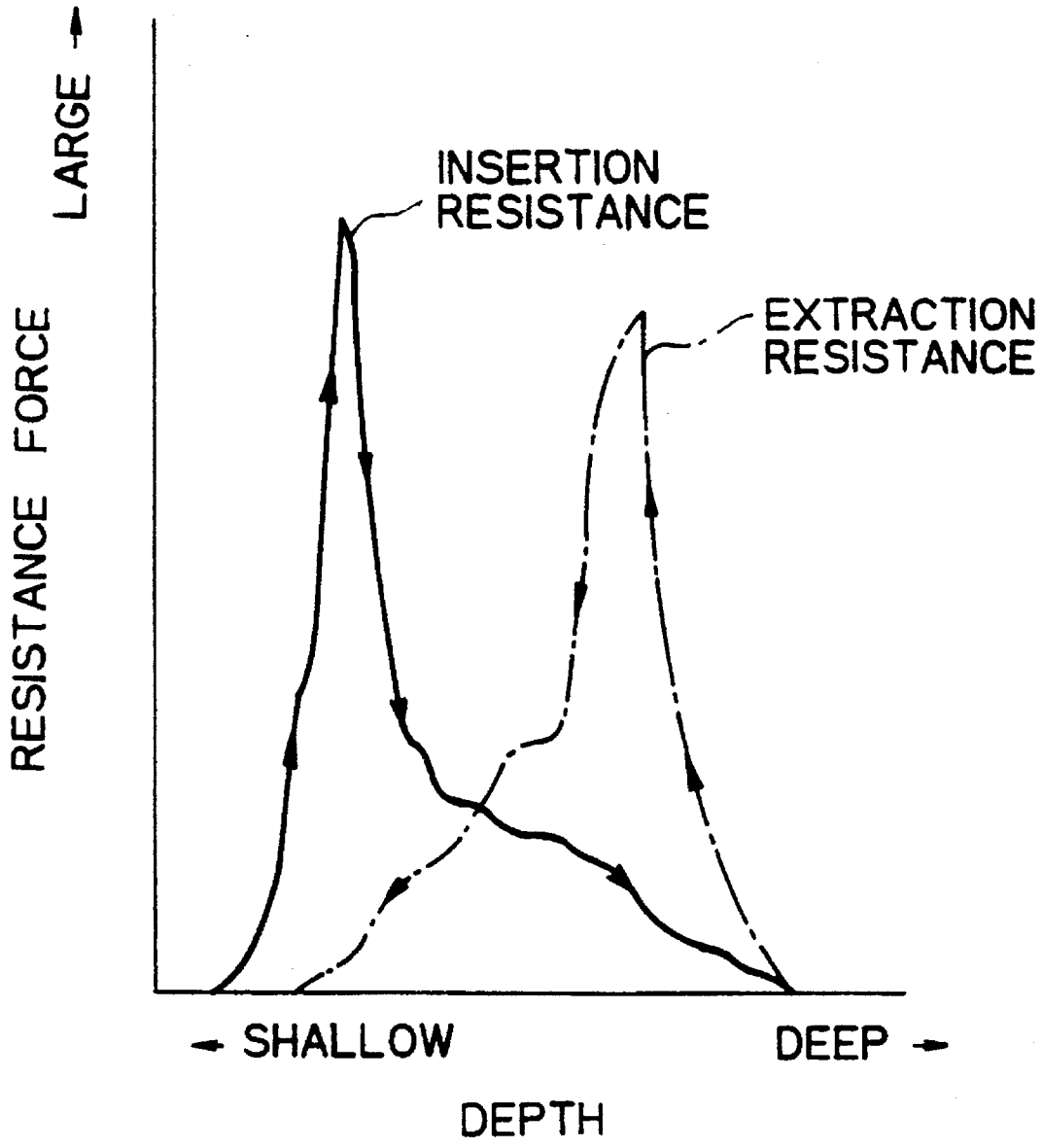
FIG. 6 is a graph which illustrates a change of resistances upon insertion and extraction of terminals.

As described above, when a condition on insertion and extraction of the female and male terminals is carefully studied, changes of resistance upon insertion and extraction are not even. FIG. 6 shows curves of insertion and extraction resistances of the terminals. In FIG. 6, the axis of the abscissa indicates a depth of the female connector housing 12 in the male connector housing 11 and the axis of the ordinate indicates a force. An insertion resistance upon inserting the terminals is changed from the left to the right as shown by a solid line while an extraction resistance upon extracting the terminals is changed from the right to the left as shown in one dotted chain line. Since a stationary frictional force becomes large upon extracting the terminals, a large extraction resistance is generated upon initial detachment of the connector and a peak appears on a resistance curve when the female connector housing 12 is disposed in a deep position.

The left side end 16*a* is different in shape from the right side end 16*b*. A width of the cam groove 16 changes along the groove in contrast to the prior art cam groove. In detail, the left side end 16*a* which serves as the cam face upon coupling the connector is shaped in accordance with the resistance curve of terminal insertion which has the peak in a shallow position as shown by the full line in FIG. 6. The right side end 16*b* which serves as the cam face upon detaching the connector is shaped in accordance with the resistance curve of terminal extraction which has the peak in a deep position as shown in one dotted chain line in FIG. 6.

In more detail, as shown in FIG. 1, the left side end 16*a* which serves as the cam face upon coupling the connector is designed so that an inclination angle of the cam face is small in an area where an angle Φ is small (an area where the cam follower boss 17 contacts with at a beginning of insertion). The right side end 16*b* which serves as the cam face upon detaching the connector is designed so that the inclination angle of the cam face is small in an area where an angle θ is large (an area where the cam follower boss 17 contacts with at a beginning of extraction). In FIG. 1, assuming that a straight line Y is defined by connecting between a turning center of the lever 14 and the boss guide of the cam follower boss 17 and a straight line A is defined by connecting between the turning center of the lever 14 and the boss 17 at any position in the groove 16, Φ is an angle between the straight lines Y and A.

In order to couple the connector in the above construction, the female connector housing 12 is inserted into the hood 18 of the male connector housing 11 and the lever 14 is turned to a direction shown by an arrow C in FIG. 3. Then, as shown in FIG. 3, the cam follower boss 17 which has advanced in the cam groove 16 is pushed down by the left side end 16*a* in the cam groove 16 so that the cover 13 and the female connector housing 12 move into the male connector housing 11. Then, the female and male terminals in the connector housings 11 and 12 are interconnected. The insertion resistance at this time inclines to show a peak shown in the solid line in FIG. 6 upon initial insertion of the female connector housing 12 (at a relatively shallow position of insertion). However, since the inclination angle of the cam face is set to be small at an area where the angle Φ is small in the left side end 16*a* in the cam groove 16 (an area where the insertion position is relatively shallow) in this embodiment, a larger pushing-down force acts on the female connector housing 12 at the first half of a coupling operation. Consequently, it is possible to push down the female connector housing by a large force in accordance with the increased insertion resistance at the first half of the coupling operation, thereby causing the lever 14 to be turned by a smooth and light actuating force.

Also, the lever 14 is turned to a direction shown by an arrow D in FIG. 4 upon detaching the connector. As shown in FIG. 4, the cam follower boss 17 is pushed down by the right side end 16*b* in the cam groove 16 and the cover 13 and the female connector housing 12 are detached from the hood 18. Thus, the female and male terminals are detached from each other. At this time, the extraction resistance inclines to show a peak under an initial detaching operation of the connector (at a deep position of the female connector 12 in the male connector housing 11) as shown by one dotted chain line in FIG. 6. In this embodiment, since the inclination angle of the cam face is set to be small at an area where the angle Φ is large in the right side end 16*b* in the cam groove 16 (an area where the insertion position is relatively deep), a larger pushing-up force acts on the female connector housing 12 at the first half of a detaching operation. Consequently, it is possible to push up the female connector housing 12 by a large force in accordance with the increased extraction resistance at the first half of the detaching operation, thereby turning the lever 14 by a smooth and light force.

Thus, in the first embodiment, since the cam faces in the form of first and second cam means 16*a* and 16*b* are shaped individually in accordance with the coupling and detaching of the connector, a force most suitable for a resistance change can act on the female connector housing 12. It is possible to turn the lever 14 by a smooth and light force upon coupling and detaching the connector.

It should be noted that the present invention is not limited to the above embodiment and the lever may be attached to the female connector housing while the cam follower boss may be provided on the male connector housing. The present invention can be applied to a connector which is coupled and detached by utilizing the "lever action".

Referring now to FIGS. 7 to 9C, a second embodiment of the lever type connector will be explained below.

The male connector housing 11 has a box like hood 18 which is opened at an upper portion. The hood 18 is provided in its interior with male terminals $T_p$ for an electrical power supply and male terminals $T_s$ for a signal transmission (see FIGS. 9A to 9C). The male terminals $T_p$ for the electrical power supply are larger and higher than the male terminals $T_s$ for the signal transmission.

Figure 7A:
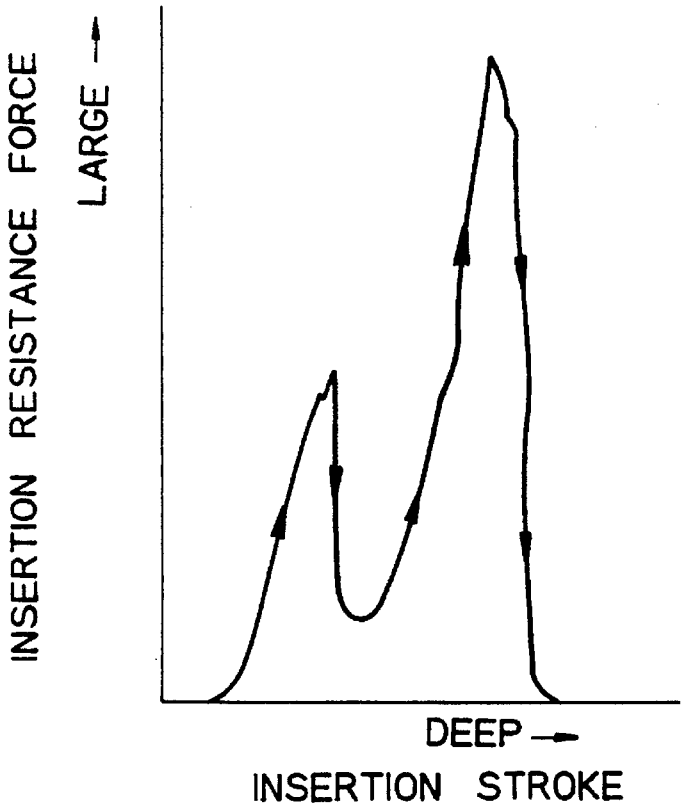
FIGS. 7A and 7B are graphs which illustrate changes of resistances upon insertion and extraction of another type of terminals.
Figure 7B:
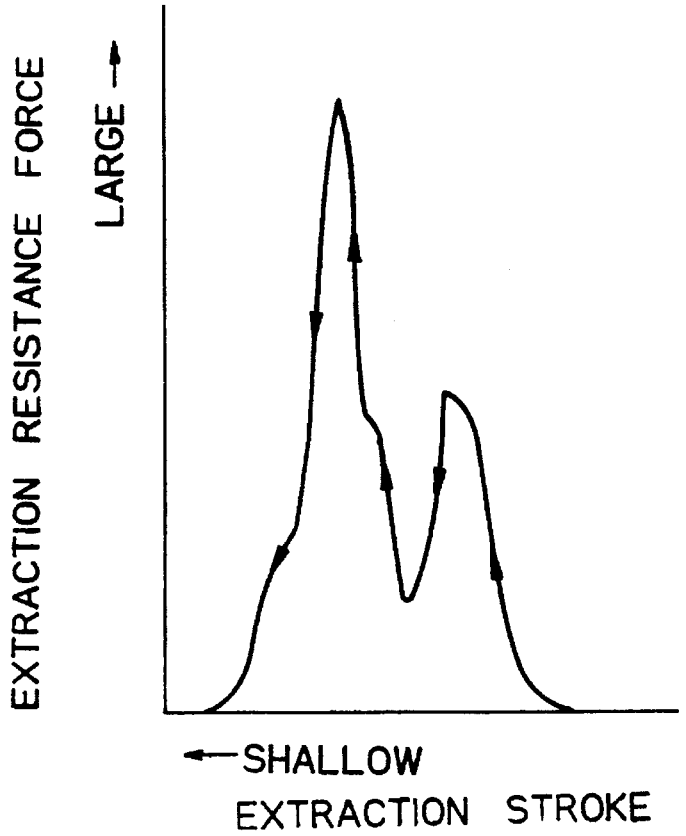
Figure 8:
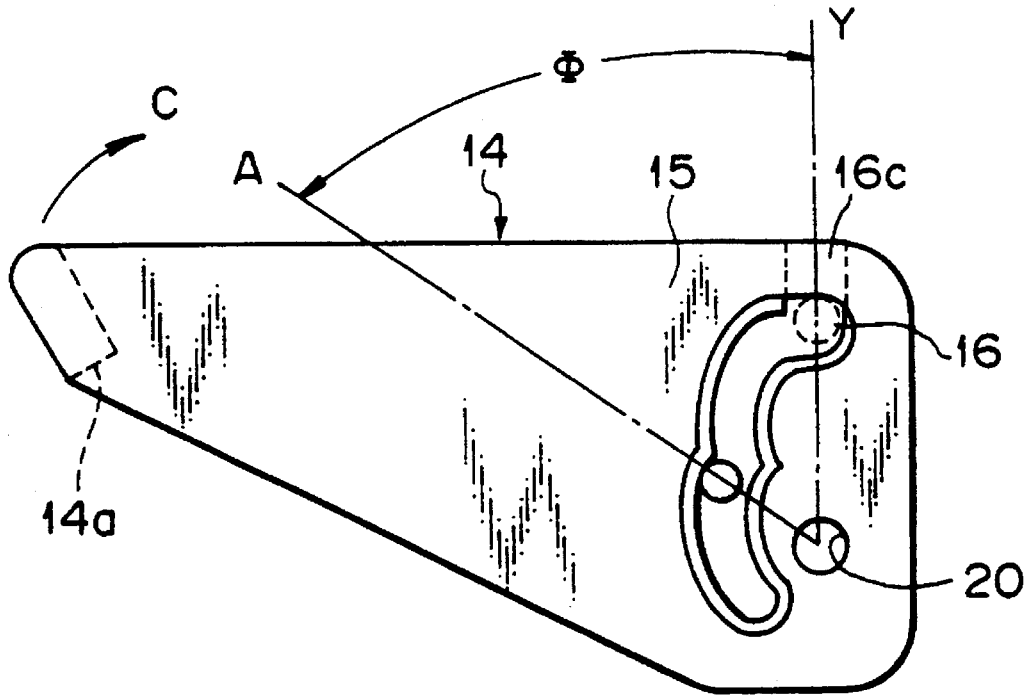
FIG. 8 is a side elevational view of another embodiment of a lever in accordance with the present invention.
Figure 9A:
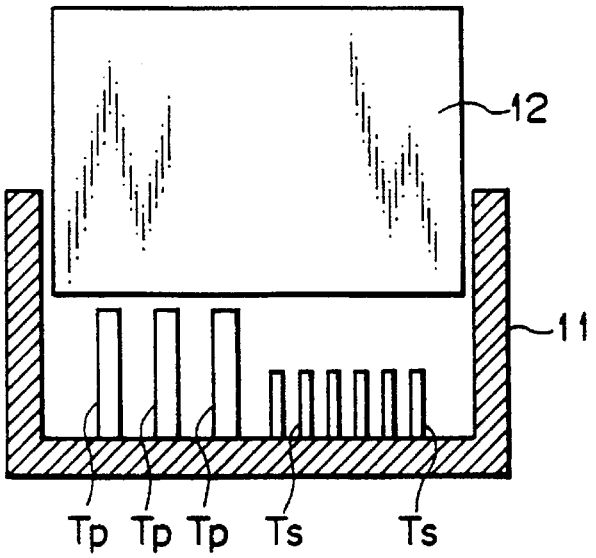
FIGS. 9A to 9C are cross sectional views of another lever type connector of the present invention, illustrating each of the coupling steps.
Figure 9B:
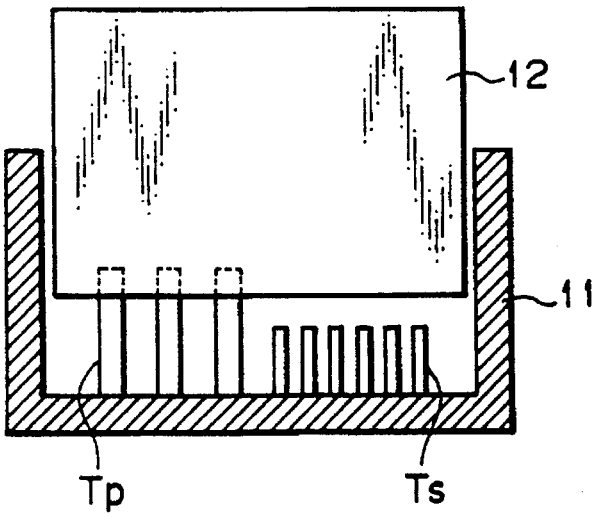
Figure 9C:
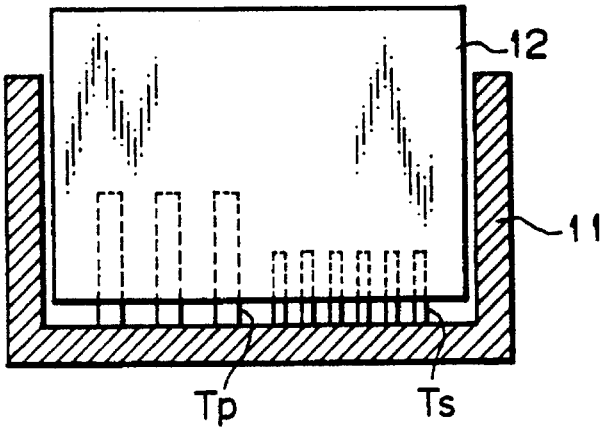
Figure 10A:
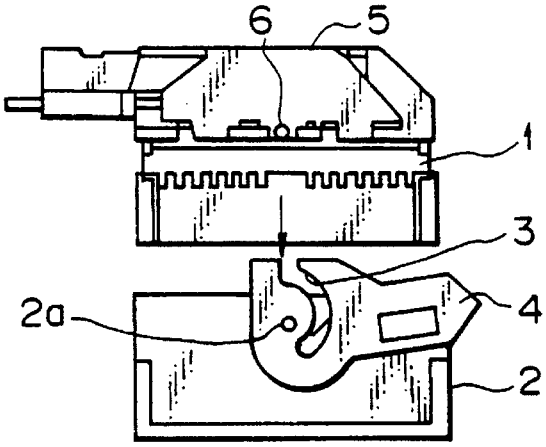
Fig. 10A PRIOR ART
FIGS. 10A to 10D are side elevational views of a prior lever type connector, illustrating each of the coupling steps.
Figure 10B:
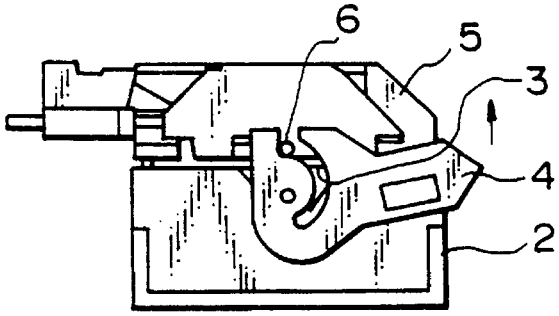
Fig. 10B PRIOR ART
Figure 10C:
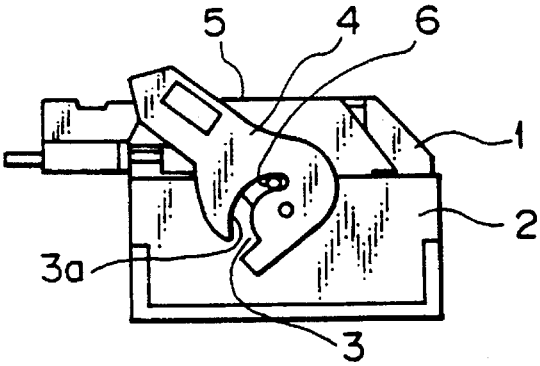
Fig. 10C PRIOR ART
Figure 10D:
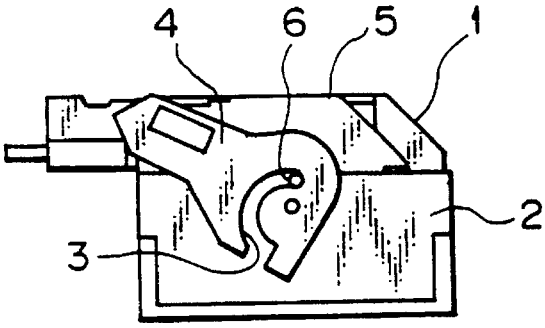
Fig. 10D PRIOR ART
Figure 11A:
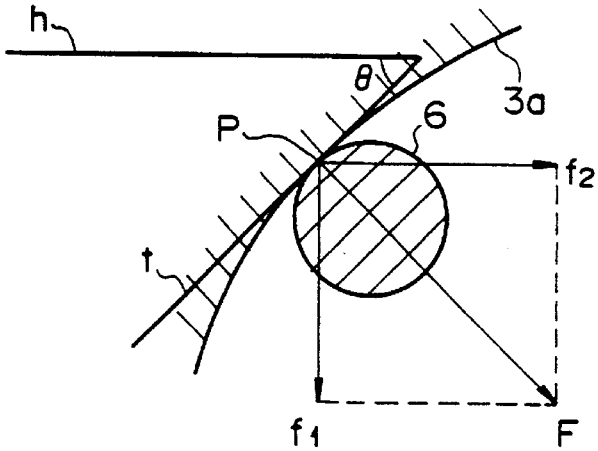
Fig. 11A PRIOR ART
FIGS. 11A and 11B are vector diagrams which illustrate a "lever action" in the prior lever type connector.
Figure 11B:
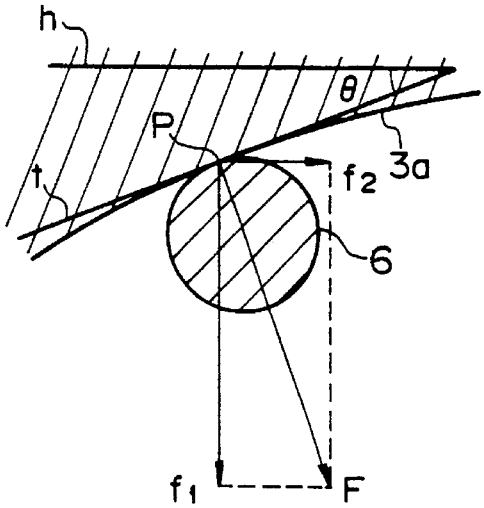
Fig. 11B PRIOR ART
Figure 12:
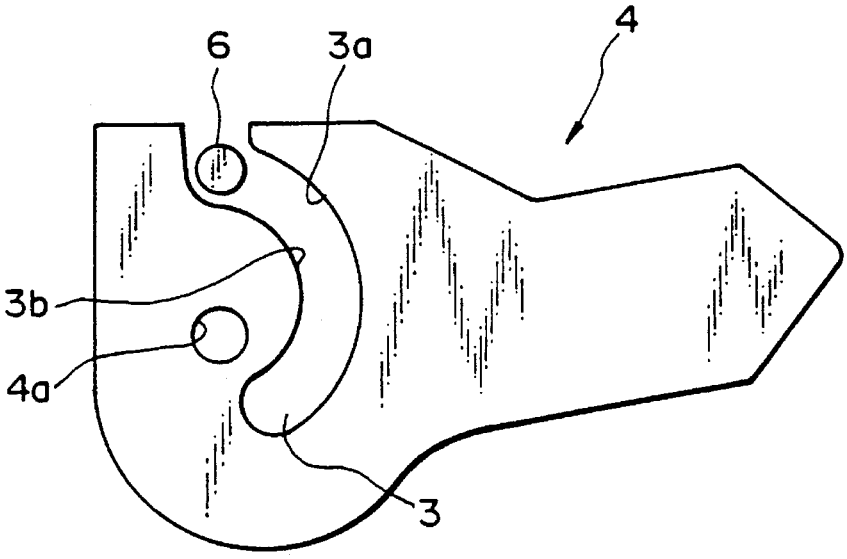
Fig. 12 PRIOR ART
FIG. 12 is a side elevational view of a prior lever, illustrating a shape of a cam groove.

The shape of the cam groove 16 in the leg 15 of the lever 14 is shown in FIG. 8. The cam groove 16 is formed in the left side with respect to the bearing bore 20 in the leg in the drawing and closed at the thin guide portion 16C. The shape of the cam groove is set in accordance with a resistance change of terminal insertion shown in FIGS. 7A and 7B described hereinafter. The cam groove is formed into a curve having two circular arcs combined by a point of inflection and two peaks.

In order to couple the connector, the lever 14 is turned to a direction shown by an arrow C in FIG. 8. Then, one of the side ends in the cam groove 16 pushes down the cam follower boss 17 so that the cover 13 and female connector housing 12 are inserted deeply in the hood 18. Consequently, the female and male terminals mounted in the connector housings are interconnected. At this time, however, since the male terminals $T_p$ for the electrical power supply are higher than the male terminals $T_s$ for the signal transmission, insertion begins from the terminals $T_p$. Accordingly, an insertion resistance of the female and male terminals alters discontinuously as shown in FIG. 7A.

However, in the second embodiment, since the cam groove 16 is designed by the discontinuous curve combining two circular arcs in accordance with the insertion resistance of the terminals shown in FIG. 7A, the discontinuous forces are applied to the female connector housing 12 in response to the insertion timings of terminals $T_p$ and $T_s$ and thus the female connector housing 12 is pushed down in accordance with the discontinuous insertion resistance of the terminals. Consequently, even if there is any discontinuous insertion resistance of the terminals, the lever 14 can be turned by a smooth and light force.

In order to detach the coupled connector, the lever 14 is turned to a reversed direction in FIG. 8. Then, since the cam follower boss 17 is pushed up by the other side end in the cam groove 16, the cover 13 and female connector housing 12 are moved from the hood 18, thereby extracting the female and male terminals. At this time, since two kinds of male terminals are provided in the second embodiment, the extraction resistance of the female and male terminals alter discontinuously in the same manner as the extraction resistance shown in FIG. 7B. However, in this case, the discontinuous force is applied to the female connector housing 12 due to the special shape of the cam groove 16 and the force accords with the discontinuous extraction resistance of the terminals, thereby turning the lever 14 by a smooth and light force.

According to the second embodiment of the present invention, since the shape of the cam groove 16 is formed discontinuously in accordance with the insertion and extraction timings of the terminals in view of the two kinds of timing of the terminals, the discontinuous coupling and detaching forces according to the timings can be applied to the female connector housing 12. Consequently, the lever 14 can be turned by a smooth and light force.

The present invention is not limited to the above embodiments and may be altered, for example, as follows:

(a) Although the lever 14 is attached to the male connector housing 11 and the female connector housing 12 is provided with the cam follower boss 17 in the above embodiments, the lever may be attached to the female connector housing while the male connector housing may be provided with the cam follower boss.

(b) Although the cam follower boss 17 is provided on the cover 13 on the female connector housing 12 in the above embodiment, the boss may be directly provided on the female connector housing.

(c) Although the right and left side ends in the cam groove 16 are substantially of the same shape in the above embodiments, they may be differed from each other. That is, since different right and left side ends in the cam groove serve as the respective cam faces upon coupling and detaching the connector, the side end which serve as the cam face upon coupling may be changed in accordance with the insertion resistance of the terminals while the other side end which serve as the cam face upon detaching the connector may be altered in accordance with the extraction of the terminals.

Further, the present invention is not limited to the above embodiments stated in the description and illustrated in the drawings and can be applied to any lever type connector having a plurality of terminals to be inserted and extracted in different timings.

What is claimed is:

1. A lever type electrical connector wherein a lever is rotatably connected to one of a pair of electrical connector housings to be coupled to each other, and said lever has a grooved cam formed therein, a cam follower boss is provided on the other of said pair of electrical connector housings, said cam follower boss is operative to engage with said grooved cam formed in said lever, and said connector housings are coupled to and detached from each other by turning said lever so that said cam follower boss is displaced along said grooved cam;

further wherein said grooved cam comprises first cam means for contacting said cam follower boss during coupling of said connector housings and with a coupling force which is in accordance with a coupling resistance of said connector housings; and second cam means for contacting said cam follower boss during detaching of said connector housings and with a detaching force which is in accordance with a detaching resistance of said connector housings and therefore is different than said coupling force;

wherein said first cam means is comprised of a first cam face engagable by said boss upon rotation of said lever in one direction, with said first cam face having a small inclination angle in an initial area of contact with said boss at the beginning of coupling of said connector housings, so that a greater coupling force is applied by said first cam face at the beginning of coupling as compared to a remainder of coupling; and wherein said second cam means is comprised of a second cam face opposed to and different in shape from said first cam face such that a width of said grooved cam changes there along, said second cam face being engagable by said boss upon rotation of said lever in an opposite direction, with said second cam face having a small inclination angle in an initial area of contact with said boss at the beginning of detaching of said connector housings when said boss is relatively deep in said grooved cam, so that a greater detaching force is applied by said second cam face at the beginning of detaching as compared to a remainder of detaching.

* * * * *